United States Patent [19]

Takeuchi

[11] 4,300,712

[45] Nov. 17, 1981

[54] PAPER FEEDER DEVICE FOR MINIATURIZED PRINTERS

[75] Inventor: Shuhei Takeuchi, Morioka, Japan

[73] Assignee: Alps Electric Co., Ltd., Tokyo, Japan

[21] Appl. No.: 148,734

[22] Filed: May 12, 1980

[30] Foreign Application Priority Data

May 11, 1979 [JP] Japan ..... 54-62890

[51] Int. Cl.[3] ..... B65H 17/22

[52] U.S. Cl. ..... 226/157; 226/144

[58] Field of Search ..... 226/157, 156, 152, 24, 226/38, 129, 147, 148, 144, 145, 146; 400/154.5, 149, 611, 616, 617, 634, 636

[56] References Cited

U.S. PATENT DOCUMENTS

| | | | |
|---|---|---|---|
| 2,584,195 | 2/1952 | Evans | 226/157 |
| 2,933,931 | 4/1960 | Lisinski | 226/144 X |
| 3,288,028 | 11/1966 | Sours | 226/144 X |
| 3,511,426 | 5/1970 | Whitmore et al. | 226/145 |
| 3,677,452 | 7/1972 | Wallace | 226/157 X |
| 3,679,113 | 7/1972 | Startzman | 226/157 X |
| 3,978,736 | 9/1976 | Igelhaut | 226/157 X |
| 4,032,055 | 6/1977 | Costa | 226/157 X |
| 4,033,560 | 7/1977 | Frey | 226/157 |
| 4,051,942 | 10/1977 | Suzuki et al. | 400/149 |
| 4,133,422 | 1/1979 | Suzuki et al. | 400/154.5 |

FOREIGN PATENT DOCUMENTS

| | | | |
|---|---|---|---|
| 1359321 | 3/1964 | France | 226/157 |
| 463162 | 11/1968 | Switzerland | 226/157 |
| 1186114 | 4/1970 | United Kingdom | 226/157 |

*Primary Examiner*—Stanley N. Gilreath

*Attorney, Agent, or Firm*—Guy W. Shoup; Gerard F. Dunne

[57] ABSTRACT

A paper feeder device for miniaturized printers, comprising a paper feed roller, first and second ratchet wheels fixedly mounted on a drive shaft of the paper feed roller and having the respective teeth inclined in the opposite directions, a first lever for driving the first ratchet wheel to rotate the paper feed roller at a predetermined amount, and a second lever which is controlled by the first lever and which has an engagement pawl capable of being inserted into a recess between two adjacent teeth of the second ratchet wheel.

4 Claims, 4 Drawing Figures

PAPER FEEDER DEVICE FOR MINIATURIZED PRINTERS

BACKGROUND OF THE INVENTION

1. Field of the Invention

The present invention relates to a paper feeder device for miniaturized printers and, more particularly, to a paper feeder device for feeding paper while intermittently rotating a paper feed roller by the driving force of an electromagnetic plunger.

2. Description of the Prior Art

Miniaturized printers have become popular in recent years and are being mounted in portable electronic desk calculators. A greater part of this kind of miniaturized printers employ a paper feed mechanism using an electromagnetic plunger.

There are U.S. Pat. No. 4,133,422 and U.S. Pat. No. 4,051,942 which are directed to the above-mentioned kind of printers and which are based on patent applications filed on behalf of the assignee of the present invention.

Although the paper feed mechanisms mentioned above can be assembled easily at a low cost, a voltage supplied to the electromagnetic plunger varies so that the paper cannot be fed stably.

In a conventional paper feed mechanism as shown in FIG. 1, a pawl 22 of a lever operatively connected to an operation rod of an electromagnetic plunger is moved in the direction of the arrow to rotate a ratchet wheel 21 in the same direction at one pitch angle, which ratchet wheel 21 is mounted on a drive shaft 20 having a paper feed roller fixedly mounted thereon. When a voltage supplied to the electromagnetic plunger varies, the ratchet wheel 21 is rotated at more than one pitch angle by the inertia force. This sometimes causes an engement pawl 23, which is repeatedly engaged with and disengaged from a recess between two adjacent teeth of the ratchet 21, and which is resiliently pressed by a spring, to pass off a predetermined engagement position or stop the ratchet wheel 21 in a position where the ratchet wheel 21 has been rotated at two or more pitch angles.

An excessive paper feed caused by such an excessive rotation of the ratchet wheel as mentioned above is called "paper skip". This causes a broken file so that the quality of typewritten data is greatly decreased.

SUMMARY OF THE INVENTION

Therefore, an object of the present invention is to provide a paper feeder device for miniaturized printers, which permits feeding paper stably irrespective of variations in a voltage supplied to an electromagnetic plunger.

To this end, the present invention provides a paper feeder device for miniaturized printers, comprising a paper feed roller, first and second ratchet wheels fixedly mounted on a drive shaft of the paper feed roller and having the respective teeth inclined in the opposite directions, a first lever for driving the first ratchet wheel to rotate the paper feed roller at a predetermined amount, and a second lever which is controlled by the first lever and which has an engagement pawl capable of being inserted into a recess between two adjacent teeth of the second ratchet wheel.

The above and other objects as well as the advantageous features of the present invention will become clear from the following description of the preferred embodiment taken in conjunction with the accompanying drawings.

DESCRIPTION OF THE PREFERRED EMBODIMENT

Figure 1:
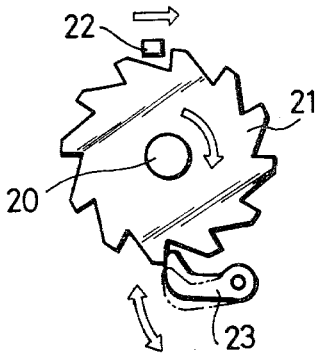
Fig. 1 PRIOR ART
FIG. 1 illustrates the action of a prior art paper feeder device.

An embodiment of the present invention will be described with reference to FIGS. 3*a*, and 3*b*.

Referring to the drawings, reference numeral 1 denotes a drive shaft on which a paper feed roller 2 is fixedly mounted, and this drive shaft 1 is rotatably supported on a frame (not shown). Reference numeral 3 denotes a driven shaft on which a driven roller 4 is fixedly mounted. The driven shaft 3 is rotatably supported in the same manner as the drive shaft 1, and always elastically pressed by a spring toward the drive shaft 1 so that paper 5 can be fed as it is held between the rollers 2, 4.

The drive shaft 1 is provided with a first ratchet wheel 6 for use in feeding paper, and a second ratchet wheel 7 for use in controlling the amount of rotation of the drive shaft 1, both of which ratchet wheels 6, 7 are fixedly mounted on the shaft 1. The teeth of the first and second ratchet wheels 6, 7 are inclined in the opposite directions. The number of teeth of the first ratchet wheel 6 is equal to that of the second ratchet 7, and the diameter of the latter ratchet wheel 7 is somewhat smaller than that of the former ratchet 6.

Reference numeral 8 denotes an electromagnetic plunger having an operation rod 8*a*, and an L-shaped first lever 9 is connected at one end portion thereof to the front end portion of the operation rod 8*a* with a pin 10. The first lever 9 is pivotally supported at its intermediate portion thereof on a support post 11. A drive pawl 9*a* is provided at the other end portion of the first lever 9 such as to be engageable with teeth 6*a* of the first ratchet wheel 6.

Figure 2:
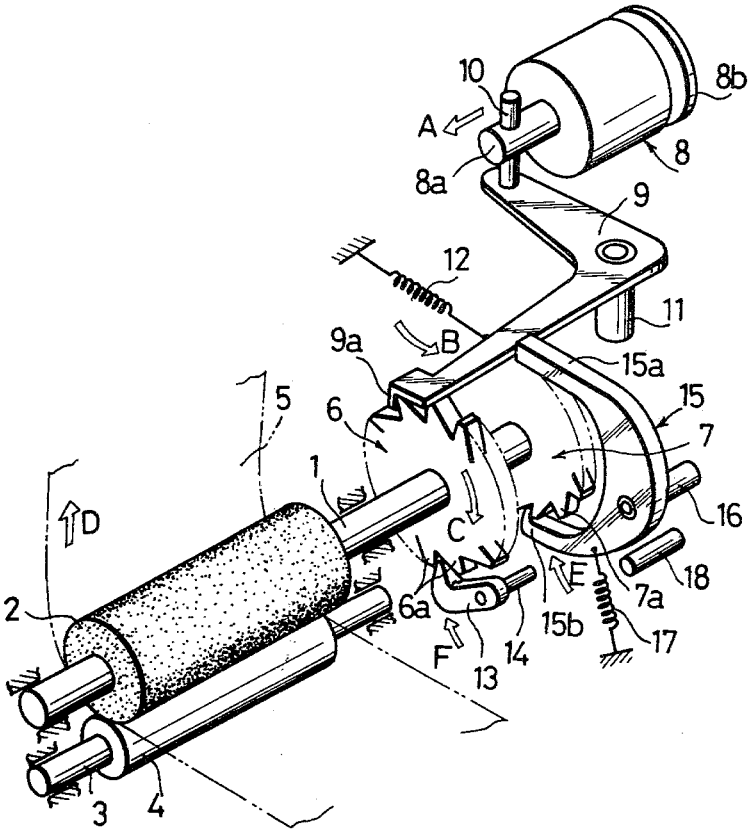
FIG. 2 is a perspective view of a paper feeder device embodying the present invention.

Reference numeral 12 denotes a spring for constantly applying a rotary force to the first lever 9 in a direction opposite to the direction shown with an arrow B in FIG. 2. Although the spring 12 in the embodiment shown in the drawings is provided between the first lever 9 and frame, it may be substituted by an operation rod 8*a* returning spring provided in or connected to, for example, the above-mentioned electromagnetic plunger 8.

Reference numeral 13 denotes a pawl for use in preventing the ratchet wheel 6 from being rotated in the reverse direction. The pawl 13 is pivotally supported on its shaft 14 and is constantly resiliently urged in a direction of an arrow F in FIG. 2 by a spring (not shown). The pawl 13 is adapted to come into engagement with and come out of engagement from the teeth 6*a* of the ratchet wheel 6 in a repeated manner while the ratchet wheel 6 is rotated.

Reference numeral 15 denotes a substantially U-shaped second lever which is pivotally supported at its intermediate portion on a support rod 16 and which is constantly urged by a spring 17 in a circular direction of an arrow E in FIG. 2. The second lever 15 is opposed at its one end 15*a* to the first lever 9, and engageable at an engagement pawl 15*b* at the other end thereof with teeth 7*a* of the second ratchet wheel 7.

Referring to FIG. 2, reference numeral 18 denotes a stopper for the second lever 15, and 8*b* a stopper connected to the operation rod 8*a* of the electromagnetic plunger 8.

The operation of the embodiment of the present invention of the above-described construction will now be described.

Before the electromagnetic plunger 8 has been energized i.e. when the electromagnetic plunger 8 is not in operation, the drive pawl 9*a* of the first lever 9 and engagement pawl 15*b* of the second lever 15 are separated from the teeth 6*a*, 7*a*, respectively, of the first and second ratchet wheels 6, 7.

When an electric current is then applied to the electromagnetic plunger 8 in accordance with a line changing instruction from a control circuit in a printer body, the operation rod 8*a* of the electromagnetic plunger 8 is driven in the direction of an arrow A in FIG. 2 to drive the first lever 9 pivotally in the direction of an arrow B in the same drawing. As a result, the drive pawl 9*a* of the first lever 9 comes into engagement with the teeth 6*a* of the first ratchet wheel 6 to rotate the first ratchet wheel 6 one pitch angle in the direction of an arrow C. Such a rotary movement of the first ratchet wheel 6 causes the paper feed roller 2 to be rotated in a predetermined amount so that the paper 5 held between the paper feed roller 2 and driven roller 4 is moved in the direction of an arrow D to complete a line changing operation.

When the first lever 9 is pivotally moved as mentioned above, it comes into contact with the end 15*a* of the second lever 15 to allow the second lever 15 to be oscillated in the direction of an arrow E so that the engagement pawl 15*b* of the second lever 15 comes into engagement with the recess between two adjacent teeth 7*a* of the second ratchet wheel 7. Namely, after the first ratchet wheel 6 is rotated at one pitch angle by the first lever 9, the engagement pawl 15*b* of the second lever 15 is forcibly brought into engagement with the second ratchet wheel 7 so as to accurately prevent the first ratchet wheel 6 or drive shaft 1 from being ratated in excess of a predetermined amount.

The above operation will be explained from another aspect with reference to FIGS. 3*a* and 3*b*.

Figure 3A:
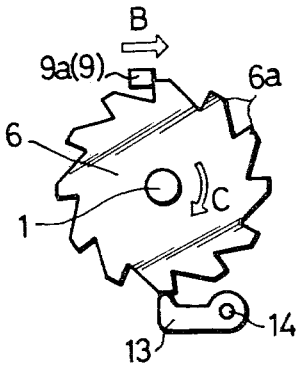
FIG. 3*a* illustrates the action of a first ratchet wheel in the embodiment shown in FIG. 2.
Figure 3B:
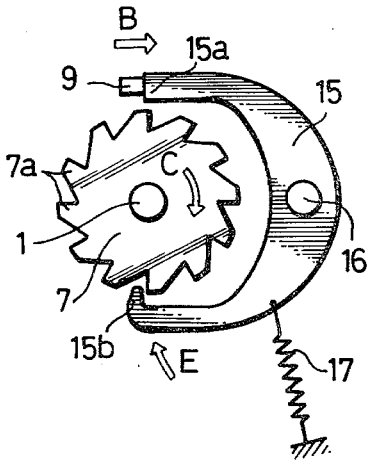
FIG. 3*b* illustrates the action of a second ratchet wheel in the embodiment shown in FIG. 2.

When the first ratchet wheel 6 is rotated in the direction of an arrow C as shown in FIG. 3*a* by the first lever 9, the engagement pawl 13 which is intended to prevent rotation of the first ratchet wheel 6 in the reverse direction is separated from the teeth 6*a* of the first ratchet wheel 6. However, the ratchet wheel 6 or drive shaft 1 is in no case rotated in excess of one pitch angle because the second lever 15 is rotated in the direction of an arrow E to allow the engagement pawl 15*b* thereof to be forcibly inserted between two adjacent teeth 7*a* as shown in FIG. 3*b*.

When the electromagnetic plunger 8 is deenergized, each lever in the paper feeder device is returned to its original position by the force of the springs to wait for a new line changing instruction.

In the above-described embodiment, each line changing operation is conducted through one energization operation for the plunger 8. Even when each line changing operation is conducted through several energization operations, the same effect can, of course, be obtained. The forms of the levers 9, 15 and the mounting positions therefor may be changed in various manners.

The present invention is not, of course, limited to the above-described embodiment; it may be modified in various manners within the scope of the appended claims.

What is claimed is:

1. A paper feeder device for miniaturized printers, comprising an electromagnetic plunger adapted to be energized at the time of paper feeding, a paper feed roller fixedly mounted on a drive shaft, a first ratchet wheel mounted fixedly on and rotated together with said drive shaft, a second ratchet wheel fixedly mounted on a portion of said drive shaft adjacent to said first ratchet wheel so as to be rotated with said drive shaft, said second ratchet wheel having teeth inclined in a direction opposite to the direction in which the teeth of said first ratchet wheel are inclined, a first lever driven by said electromagnetic plunger to come into engagement with the teeth of said first ratchet wheel and thereby rotate said paper feed roller in a predetermined amount, and a second lever driven by said first lever to allow an engagement pawl of said second lever to be inserted between two adjacent teeth of said second ratchet wheel.

2. A paper feeder device according to claim 1, wherein said device includes a reverse rotation prevention lever engageable with a tooth of said first ratchet wheel.

3. A paper feeder device according to claim 1, wherein said second lever is substantially U-shaped and pivotally supported on a shaft at the intermediate portion thereof, said second lever being capable of contacting at its one end portion said first lever and capable of being inserted at the other end thereof between two adjacent teeth of said second ratchet wheel.

4. A paper feeder device according to claim 3 wherein said second lever is urged at said engagement pawl thereof by a spring away from said second ratchet wheel.

* * * * *